US011292033B2

(12) United States Patent
Behrbom

(10) Patent No.: US 11,292,033 B2
(45) Date of Patent: Apr. 5, 2022

(54) EARPHONE CLEANING DEVICE

(71) Applicant: Patrick Behrbom, Alpine, UT (US)

(72) Inventor: Patrick Behrbom, Alpine, UT (US)

( * ) Notice: Subject to any disclaimer, the term of this patent is extended or adjusted under 35 U.S.C. 154(b) by 313 days.

(21) Appl. No.: 16/536,497

(22) Filed: Aug. 9, 2019

(65) Prior Publication Data

US 2021/0039141 A1 Feb. 11, 2021

(51) Int. Cl.

| | |
|---|---|
| ***A47L 25/00*** | (2006.01) |
| ***B08B 1/00*** | (2006.01) |
| ***H04R 1/12*** | (2006.01) |
| ***B08B 5/04*** | (2006.01) |
| ***H04R 1/10*** | (2006.01) |

(52) U.S. Cl.

CPC ..... *B08B 1/002* (2013.01); *A47L 25/00* (2013.01); *B08B 5/04* (2013.01); *H04R 1/1016* (2013.01); *H04R 1/1025* (2013.01); *H04R 1/1091* (2013.01); *A46B 2200/30* (2013.01); *A46B 2200/3073* (2013.01); *H04R 2460/17* (2013.01)

(58) Field of Classification Search

CPC ..... A47L 25/00; A46B 2200/30; B08B 1/002; B08B 1/007; B08B 5/04; A61L 2/00; H04R 1/1025; H04R 2460/17

See application file for complete search history.

(56) References Cited

U.S. PATENT DOCUMENTS

| | | | | |
|---|---|---|---|---|
| 6,490,351 | B1 | 12/2002 | Roberts | |
| 8,481,970 | B2 | 7/2013 | Cooper | |
| 8,837,714 | B1 | 9/2014 | Chen | |
| 8,964,405 | B2 | 2/2015 | La Porte et al. | |
| 9,839,707 | B2 | 12/2017 | Won | |
| 2003/0196687 | A1* | 10/2003 | Campbell | F26B 9/003 134/35 |
| 2010/0096963 | A1 | 4/2010 | McLaughlin et al. | |
| 2015/0162770 | A1* | 6/2015 | Choi | B08B 1/04 320/107 |
| 2017/0064429 | A1* | 3/2017 | Hirsch | H04W 52/0209 |

FOREIGN PATENT DOCUMENTS

| | | | |
|---|---|---|---|
| CN | 204814945 U | * | 12/2015 |
| CN | 206168831 U | * | 5/2017 |
| CN | 206894268 U | * | 1/2018 |

(Continued)

OTHER PUBLICATIONS

Derwent-Acc-No. 2018-06434K; Derwent Week 201810 (2018); Inventor Xie et al.; Patent Family Pub-No. CN 206894268 U Jan. 16, 2018.*

(Continued)

*Primary Examiner* — Randall E Chin

(74) *Attorney, Agent, or Firm* — Kirton McConkie; Alexis Nelson; David Tingey

(57) ABSTRACT

An apparatus for cleaning earphones that includes a brush element, a positioning element, and a motive element. A brush element selectively contacts and removes debris from an earphone, and a positioning element supports the earphone in a desired position relative to the brush element. A motive element is configured to move the brush element relative to the earphone. A corresponding system and method are also disclosed and claimed herein.

16 Claims, 7 Drawing Sheets

(56) References Cited

FOREIGN PATENT DOCUMENTS

| | | | |
|---|---|---|---|
| CN | 108184189 A | * | 6/2018 |
| CN | 109956141 A | * | 7/2019 |

OTHER PUBLICATIONS

Derwent-Acc-No. 2018-50232H; Derwent Week 201866 (2018); Inventor Zhang; Patent Family Pub-No. CN 108184189 A Jun. 19, 2018.*

Derwent-Acc-No. 2019-59890R; Derwent Week 201963 (2019); Inventor Yang et al.; Patent Family Pub-No. CN 109956141 A Jul. 2, 2019.*

Derwent-Acc-No. 2015-838439; Derwent Week 201610 (2015); Inventor Wu; Patent Family Pub-No. CN 204814945 U Dec. 2, 2015.*

Derwent-Acc-No. 2017-333671; Derwent Week 201736 (2017); Inventor Du; Patent Family Pub-No. CN 206168831 U May 17, 2017.*

Hamilton Buhl Hygenx-UVC Portable Automatic Headphone Sanitizer, available at www.https://www.amazon.com/Hamilton-Buhl-Automatic-Headphone-Sanitizer/dp/B00A20927A, (undated).

Hamilton Buhl Portable Automatic Headphone Sanitizer available at https://www.amazon.com/Hamilton-Buhl-Automatic-Headphone-Sanitizer/dp/B00OBPB42S, (undated).

* cited by examiner

EARPHONE CLEANING DEVICE

BACKGROUND

Field of the Invention

This invention relates to devices for cleaning earphones.

Background of the Invention

Earphones, such as in-ear headphones (also known as in-ear monitors or canalphones), earbuds, and hearables, are very small headphones that sit directly in a user's ear. Earphones are extremely popular, due to their high portability and user convenience.

In operation, earphones connect to a signal source such as an audio amplifier, radio, portable media player, mobile phone, video console, computer, or musical instrument, either directly using a cord, or wirelessly via Bluetooth® or the like. Each individual driver unit may then be fitted directly in the outer ear in the case of earbuds, or inserted into the ear canal in the case of in-ear headphones. In this manner, earphones provide a private, high-quality sound experience to a user without disturbing others nearby.

Ears are notorious, however, for producing earwax. While a suitable amount of earwax is necessary for maintaining ear health, even a small amount of earwax buildup on earphone components is neither hygienically nor aesthetically desirable. Earwax is a viscous substance that includes shed layers of skin, keratin, fatty acids, and cholesterol, along with bacteria, fungi, water, and other substances and particles that it is made to protect against. It is no surprise that an accumulation of earwax and other debris on earphone components can adversely affect a user's health by increasing a risk of ear infection and earwax blockage. The sound quality produced by the earphones may also be adversely affected.

While manual cleaning methods may be used to clean earwax and other debris from earphones, such methods tend to be cumbersome and unreliable. Additionally, known manual cleaning methods risk harming sensitive electronic components by forcing earwax and other debris farther inside the earphone, and/or exposing such components to water, chemicals, or other potentially harmful substances.

Accordingly, what are needed are devices, systems, and methods to automatically clean and/or disinfect earphones easily and reliably. Also what are needed are devices, systems, and methods that are simple to use and inexpensive to manufacture. Ideally, such devices, systems, and methods would prolong earphone life and usage by preserving the earphone's ability to produce high-quality sound, uncompromised by debris or harmful cleaning methods.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

As previously discussed, earwax is a viscous substance that includes shed layers of skin, keratin, fatty acids, and cholesterol, along with bacteria, fungi, water, and other potentially dangerous substances that it collects. It is no surprise that an accumulation of earwax and other debris on earphone components can adversely affect a user's health by increasing a risk of ear infection and earwax blockage. The sound quality produced by the earphones may also be adversely affected.

While manual cleaning methods may be used to clean earwax and other debris from earphones, such methods tend to be cumbersome and unreliable. Additionally, known manual cleaning methods risk harming sensitive electronic components by forcing earwax and other debris farther inside the earphone, and/or exposing such components to water, chemicals, or other potentially harmful substances. Devices, systems, and methods in accordance with the present invention aim to address these problems by enabling automatic earphone cleaning that is easy, effective, and safe for sensitive electronic components.

As used herein, the term "earphone" or "earphones" refers to any electronic device that sits directly in or on a user's ear, including, for example, ear-fitting headphones, in-ear monitors, canalphones, earbuds, earphones, smart headphones, hearables, and the like. The term "screen" refers to any audio-transparent material, such as a mesh, fabric, paper, or other porous materials.

Figure 1:
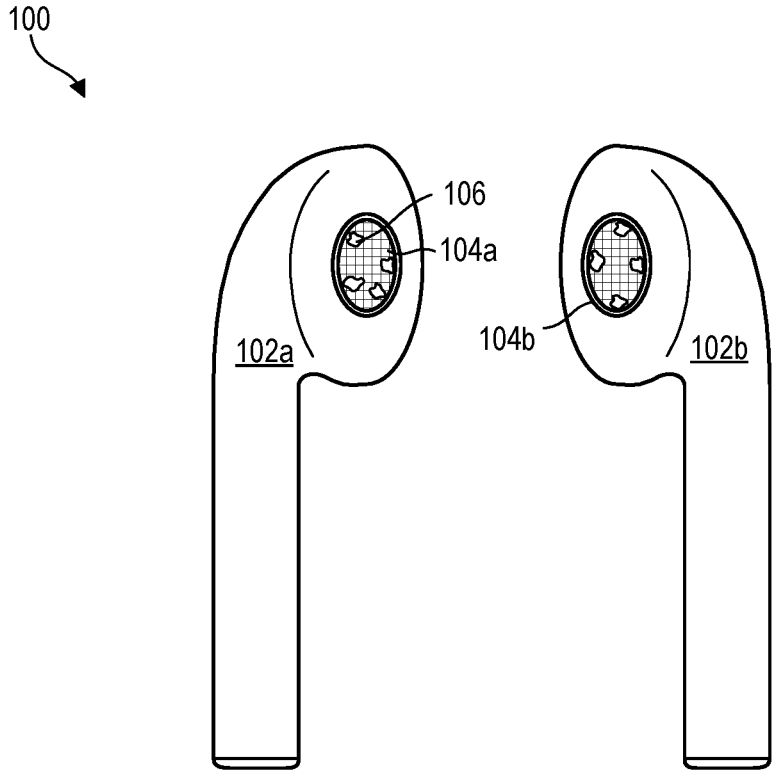
FIG. 1 is a perspective view of one embodiment of earphones that may be cleaned by an earphone cleaning device in accordance with the invention.

Referring now to FIG. 1, earphones 100 may include sensitive electronic components (such as drivers, chips, magnets, diaphragms, electrical wiring, aluminum coils) contained within a rigid or substantially rigid housing 102*a*, 102*b*. The outer shell of the housing 102*a*, 102*b* may comprise hard plastic which, in some cases, may include a rubber element around or incorporated with the housing 102*a*, 102*b* to provide extra user comfort. In some embodiments, the housing 102*a*, 102*b* may be designed to be supported exclusively by the outer contours of a user's ear. Alternatively, the housing 102*a*, 102*b* may include certain components to fit into and be retained by a user's ear canal.

In either case, audio filters or screen components 104*a*, 104*b* may be integrated into an earphone 100 to allow sound produced by the earphone 100 to flow from an audio channel to ears of a user, while protecting internal earphone 100 components from potential damage from external sources. Screen components 104*a*, 104*b* may be coupled to or integrated with an external surface of each housing 102*a*, 102*b* to prevent dust and debris 106 from contacting sensitive internal components.

Debris 106 collection onto screen components 104*a*, 104*b*, however, may cause various problems. As previously mentioned, an accumulation of earwax and other debris 106 onto the screen components 104*a*, 104*b* may be both unsanitary and aesthetically undesirable. Additionally, such debris 106 may impede the quality of sound produced and/or received by the earphones 100.

Figure 2:
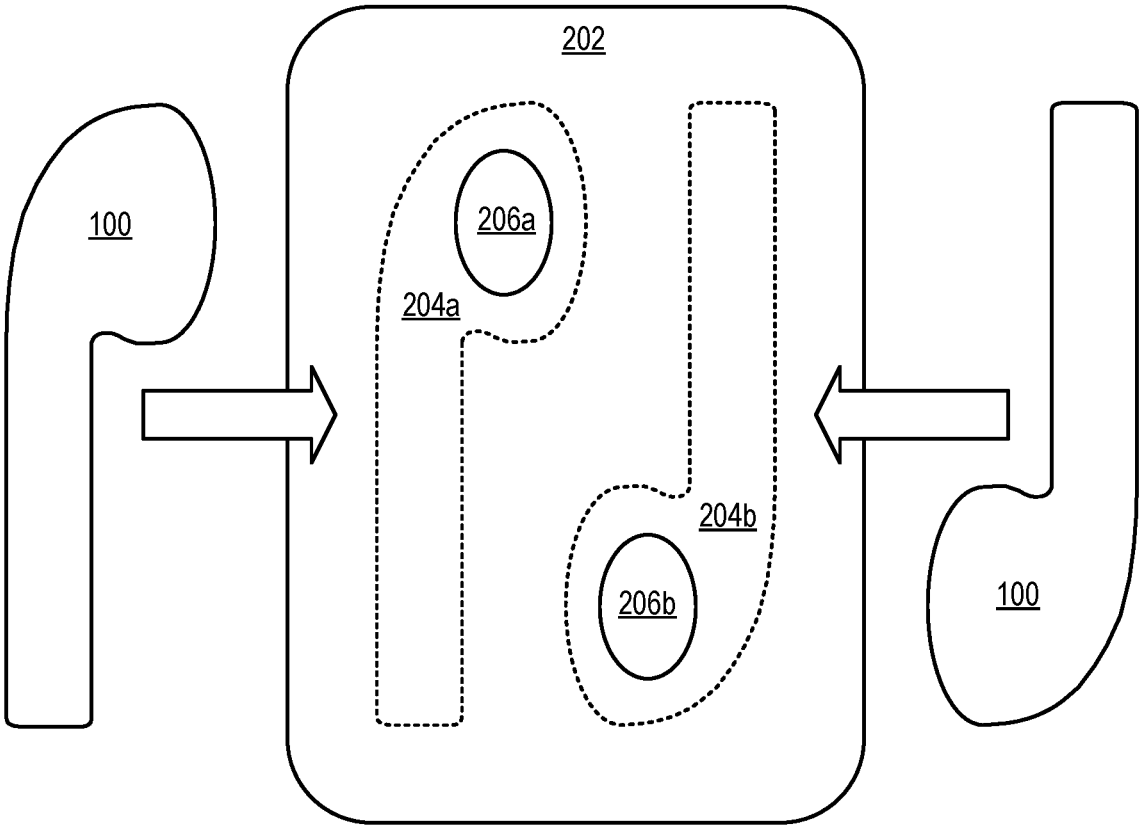
FIG. 2 is a top view of a tray for positioning earphones in an earphone cleaning device in accordance with embodiments of the invention.

Referring now to FIG. 2, embodiments of the present invention may address these issues by providing devices and methods to automatically and effectively remove debris 106 from screen components 104*a*, 104*b* or audio channels 104*a*, 104*b* of an earphone 100. In certain embodiments, a cleaning device in accordance with the invention may include a positioning element 202 or tray 202 to position earphones 100 such that the screen components 104*a*, 104*b* may selectively contact and align with a cleaning element, such as a brush.

As shown, one embodiment of a tray 202 may include depressions 204*a*, 204*b* substantially corresponding to a size and configuration of earphones 100 to be cleaned. Alternatively, a tray 202 may include ridges or other physical boundaries or features to automatically position earphones 100 at desired locations. In certain embodiments, multiple replaceable trays 204 having depressions 204*a*, 204*b* of varying sizes and shapes may be provided to accommodate different earphones 100 having corresponding sizes and shapes. In some embodiments, a single tray 202 may include depressions 204*a*, 204*b* of varying sizes and shapes to accommodate a variety of different earphones 100.

In one embodiment, the tray 202 may be made of a lightweight molded plastic material having depressions 204*a*, 204*b* therein to substantially match earphones 100 having a specified type and shape. The tray 202 may be removable and replaceable by any of various other trays 204, each having different depressions 204*a*, 204*b* to accommodate various types and/or styles of earphones 100. In another embodiment, the tray 202 may include a base element configured to support one or more liners having depressions 204*a*, 204*b* or other physical features to accommodate various types and/or styles of earphones 100. A number of depressions 204*a*, 204*b* or other physical features in each tray 202 or liner may be varied as desired to accommodate any number of different earphones 100. Of course, a single tray 202 and/or liner may be repeatedly reused as desired.

The tray 202 may include one or more apertures 206*a*, 206*b* substantially corresponding to a position of the screen components 104*a*, 104*b* and associated audio channels of the earphones 100 when placed in the tray 202 and positioned by the depressions 204*a*, 204*b* or other physical features. Each aperture 206*a*, 206*b* may be located to correspond to a brush element or other cleaning element, as discussed in more detail below. The dimensions and location of each aperture 206*a*, 206*b* may allow the brush element or cleaning element to contact the screen components 104*a*, 104*b* for cleaning.

Figure 3:
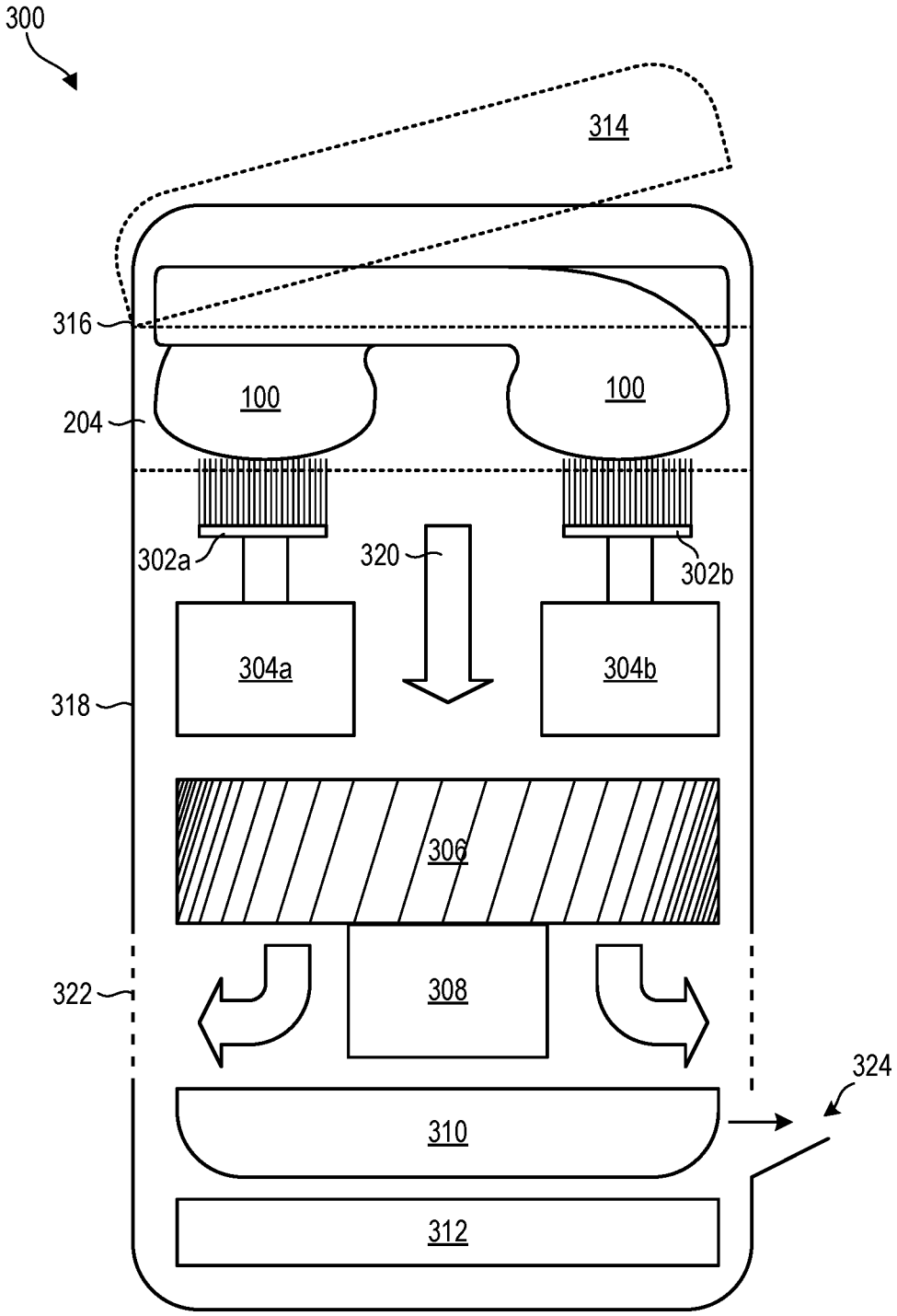
FIG. 3 is a cutaway side view of one embodiment of an earphone cleaning device in accordance with the invention.

FIG. 3 is a high-level diagram illustrating an exemplary embodiment of a cleaning device 300 in accordance with the invention. As shown, the cleaning device 300 may include an external housing 318 made of hard plastic or other substantially rigid material to protect internal cleaning components. The housing 318 may include a positioning element (e.g., tray 202) for receiving and positioning earphones 100, and a cover 314 or lid configured to fit thereover. In some embodiments, the tray 202 may be removable and/or replaceable with respect to the housing 318. The cover 314 may be attached to the housing 318 via a hinge 316, or may be fit onto the housing 318 via a press fit, or by any other means known to those in the art. In one embodiment, the cover 314 may include ventilation holes (not shown) thereon to facilitate air flow through the cleaning device 300.

As described above, embodiments of a tray 202 in accordance with the invention may include depressions 204*a*, 204*b*, ridges, or other physical boundaries or features to automatically position earphones 100 such that their screen components 104*a*, 104*b* may contact one or more cleaning elements, such as the brush elements 302*a*, 302*b* shown. In some embodiments, the depressions 204*a*, 204*b* may position the screen components 104*a*, 104*b* to contact one or more brush elements 302*a*, 302*b* through apertures 206*a*, 206*b* in the tray 202.

Each brush element 302*a*, 302*b* may, in certain embodiments, include a plurality of bristles made of, for example, nylon, rubber, and/or other natural or synthetic materials adapted to contact the screen components 104*a*, 104*b* to remove debris 106 therefrom. In certain embodiments, the bristles may be substantially flexible to facilitate gentle cleaning of the screen components 104*a*, 104*b*. The bristles may also be non-abrasive such that debris 106 may be removed from the screen components 104*a*, 104*b* without causing damage thereto.

Brush elements 302*a*, 302*b* may include dimensions such that the brush elements 302*a*, 302*b* selectively contact corresponding screen components 104*a*, 104*b* through the tray 202. In certain embodiments, each brush element 302*a*, 302*b* has a brush surface area equal to or greater than a surface area of a corresponding screen component 104*a*, 104*b*. In this manner, brush elements 302*a*, 302*b* may, in certain embodiments, contact the entire surface of corresponding screen components 104*a*, 104*b* such that they may be cleaned in their entireties.

Motive elements 304*a*, 304*b*, such as motors, may mechanically move, rotate, and/or oscillate associated brush elements 302*a*, 302*b* relative to the screen components 104*a*, 104*b* of the earphones 100. Alternatively, motive elements 304*a*, 304*b* may move, rotate, and/or oscillate the positioning element or tray 202 containing the earphones 100 relative to the brush elements 302*a*, 302*b*. In either case, movement and/or friction between the brush elements 302*a*, 302*b* and the screen components 104*a*, 104*b* may gently dislodge any dust or debris 106 from the screen components 104*a*, 104*b*.

In some embodiments, the cleaning device 300 may further include a vacuum element, such as a fan 306 powered by a motor 308, to create a vacuum or airflow within the device 300. For example, the fan 306 may pull air through the cleaning device 300, drawing debris 106 dislodged from the screen components 104*a*, 104*b* through the device 300 in the direction 320. As shown, in some embodiments, the direction 320 of air flow may be downward through the cleaning device 300, and then outward through ventilation holes 322 located, for example, in sides of the housing 318. Other paths for routing air flow are also possible. In one embodiment, ventilation holes may also be included in the cover 314 of the device 300 to facilitate drawing air through the device in a direction 320 from top to bottom.

In one embodiment, a collection element 310 may be provided near a base of the cleaning device 300 to collect the debris 106. The collection element 310 may, in certain embodiments, be selectively removed through an opening 324 in the housing 318. Alternatively, the collection element 310 may simply be emptied through the opening 324 in the housing 318. In certain embodiments, the collection element 310 may include a filter or entrapment mechanism to prevent debris 106 from escaping the collection element 310 after collection.

In some embodiments, the housing 318 further hosts a power source, such as a battery 312, to power the various internal cleaning components 304, 308 described above. Additionally, in one embodiment, a charging element (not shown) may be connected to or integrated with the housing 318 or tray 202 to automatically charge the battery 312 and/or earphones 100 during operation of the cleaning device 300. In certain embodiments, the charging element may wirelessly charge the earphones 100 (using magnetic induction, for example) upon their placement in the tray 202. In other embodiments, the charging element may directly connect to the earphones 100 for charging.

Figure 4:
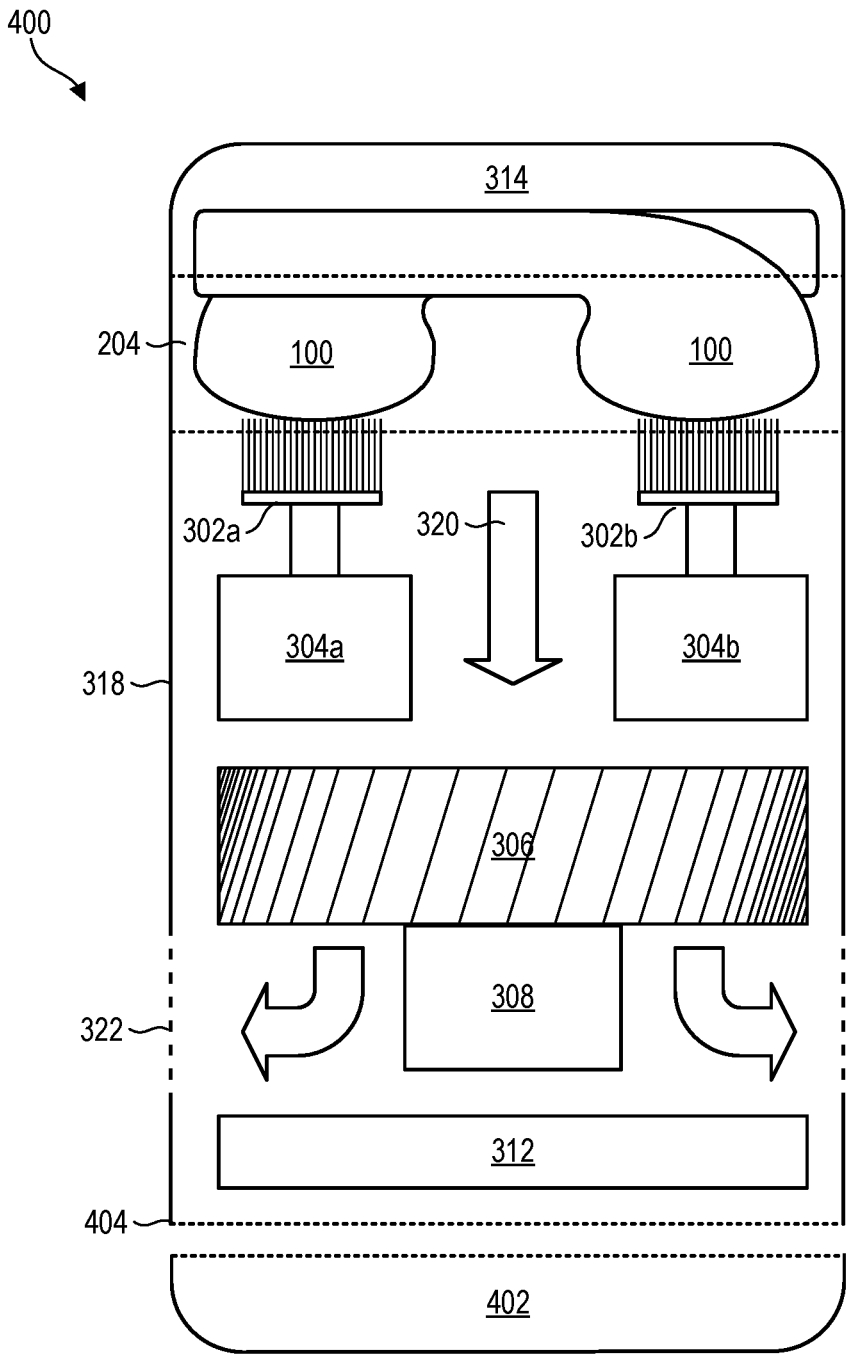
FIG. 4 is a cutaway side view of another embodiment of an earphone cleaning device in accordance with the invention.

Referring now to FIG. 4, in certain embodiments, a cleaning device 400 in accordance with the invention may include a collection element 402 that is part of the housing 318 while being removeable therefrom. For example, in one embodiment, the collection element 402 is a removable tray that attaches to a bottom end 404 of the cleaning device 400. Gravity and the direction 320 of air flow created by the vacuum element or fan 306 within the housing 318 may carry debris 106 from the earphones 100 downward through the cleaning device 400 and into collection element 402. The collection element 400 may be removed from the cleaning device 400, emptied, and reattached thereto.

In one embodiment, an outside perimeter of the collection element 402 substantially corresponds to outer dimensions of the end 404 of the housing 318 such that it may be attached thereto via a press fit. To release the collection element 402 from the housing 318, a user may gently press opposite sides of the collection element 402 to easily release the collection element 402 for emptying. In other embodiments, the collection element 402 may attach to the end 404 of the housing 318 by one or more hinges, or by any other means known to those in the art.

Figure 5:
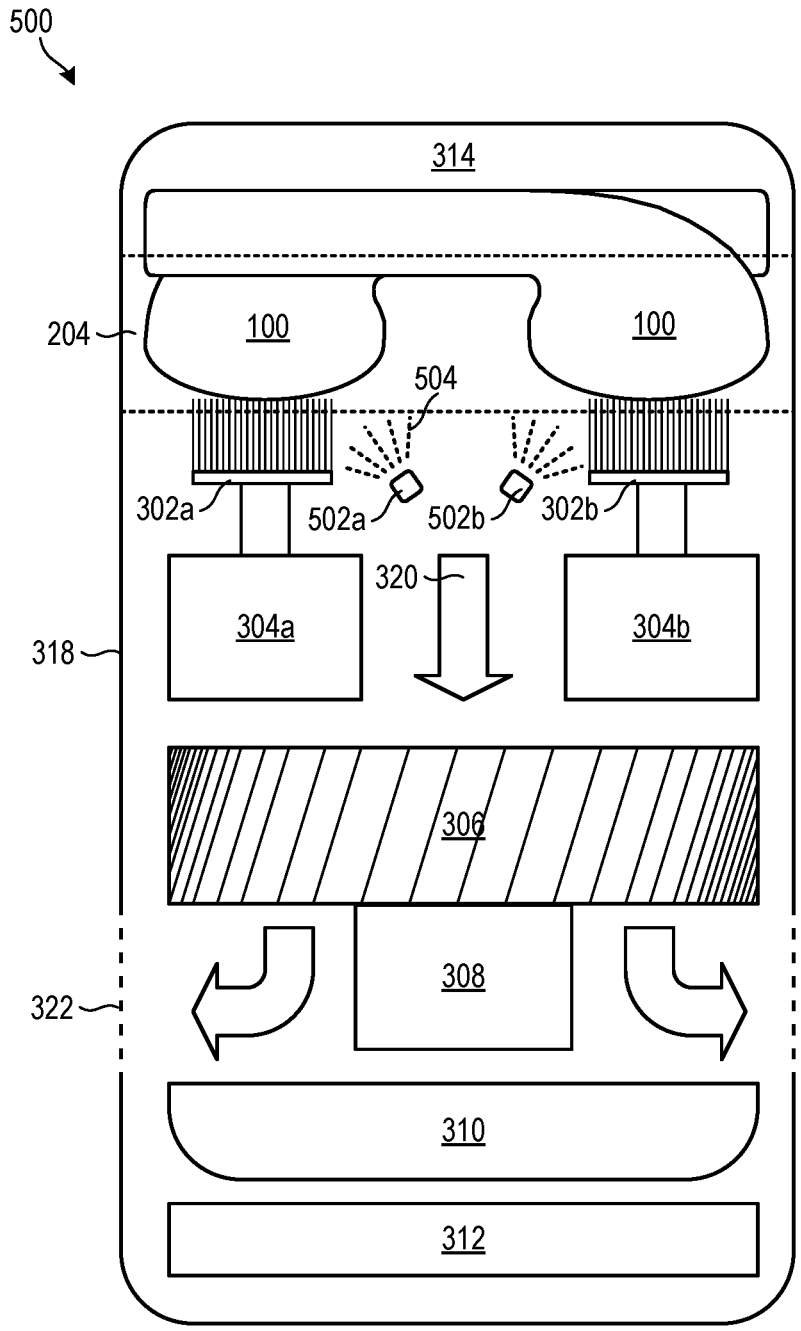
FIG. 5 is a cutaway side view of a third embodiment of an earphone cleaning device in accordance with the invention.

Referring now to FIG. 5, some embodiments of a cleaning device 500 may include one or more sanitizing elements 502*a*, 502*b* to dispense or spray a sanitizing or cleaning solution onto the screen components 104*a*, 104*b* through the tray 202. The sanitizing or cleaning spray may include, for example, ethyl or isopropyl alcohol and, in some embodiments, a disinfectant. In alternative embodiments, the sanitizing elements 502*a*, 502*b* may include emitters capable of emitting and focusing short-wavelength ultraviolet ("UV") light or sanitizing radiation onto the screen components 104*a*, 104*b* to kill germs or other microbes.

In some embodiments, sanitizing elements 502*a*, 502*b* may implement more than one sanitization stage. For example, in a first stage, sanitizing elements 502*a*, 502*b* may spray a sanitizing or cleaning solution onto the screen components 104*a*, 104*b*. In the second stage, additional sanitizing elements 502*a*, 502*b* or lamps may focus UV light or other radiation onto the screen components 104*a*, 104*b* to disinfect them. In any case, sanitizing elements 502*a*, 502*b* may be pneumatically, mechanically, or electrically driven by any mechanism known to those in the art, and may be powered by the battery 312 or other power source included in the housing 318.

In certain embodiments, the sanitizing elements 502*a*, 502*b* may be actuated before, during, or after actuation of the brush elements 302*a*, 302*b* to augment the mechanical cleaning capabilities of the brush elements 302*a*, 302*b*. In some embodiments, operation of the sanitizing elements 502*a*, 502*b* may be staggered in time with respect to actuation of the brush elements 302*a*, 302*b*. For example, where the sanitizing elements 502*a*, 502*b* emit ultraviolet light, it may be desirable to actuate the sanitizing elements 502*a*, 502*b* after the brush elements 302*a*, 302*b* have mechanically cleaned the earphones 100.

Figure 6:
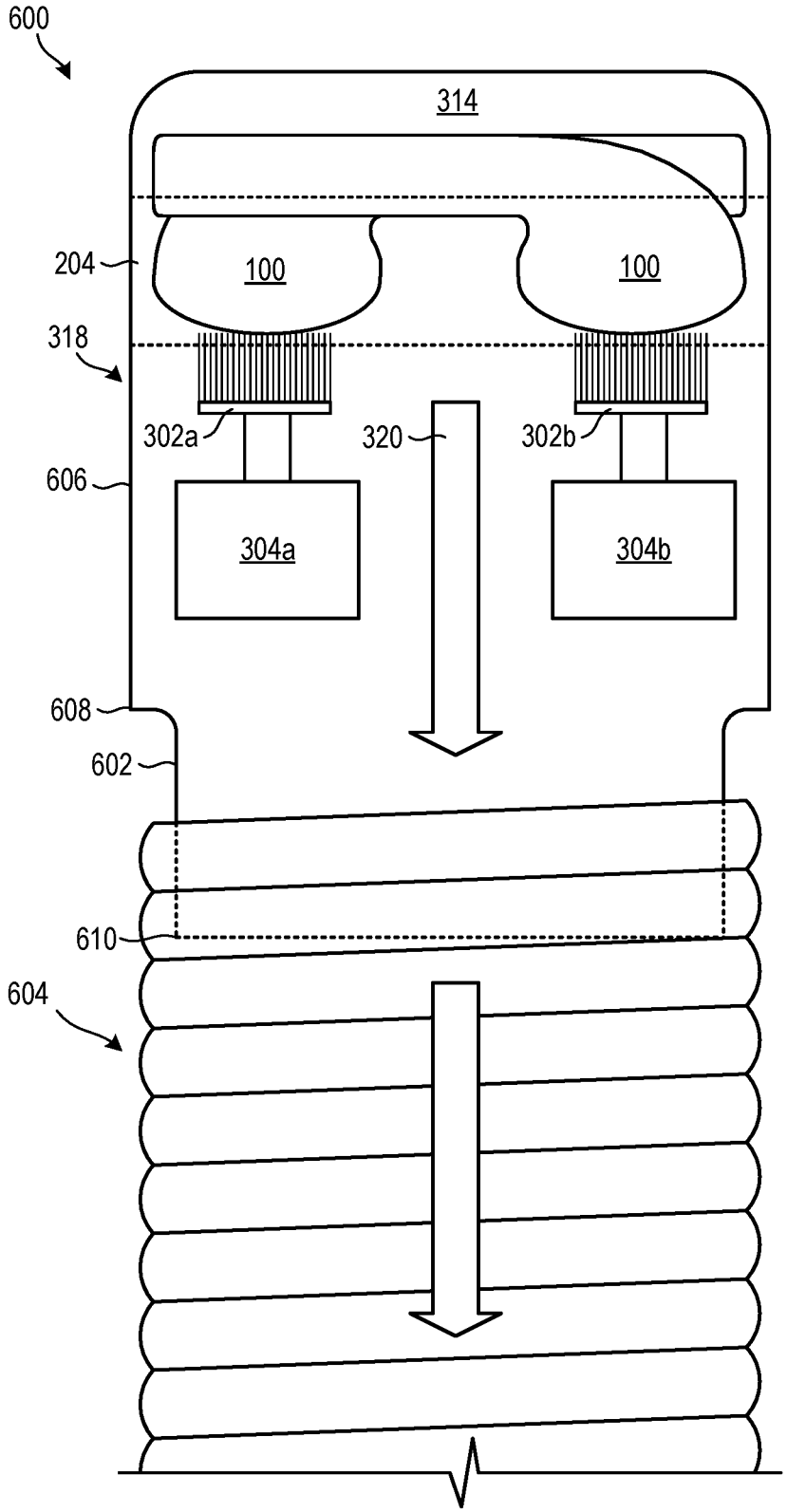
FIG. 6 is a cutaway side view of a fourth embodiment of an earphone cleaning device in accordance with the invention.
Figure 7:
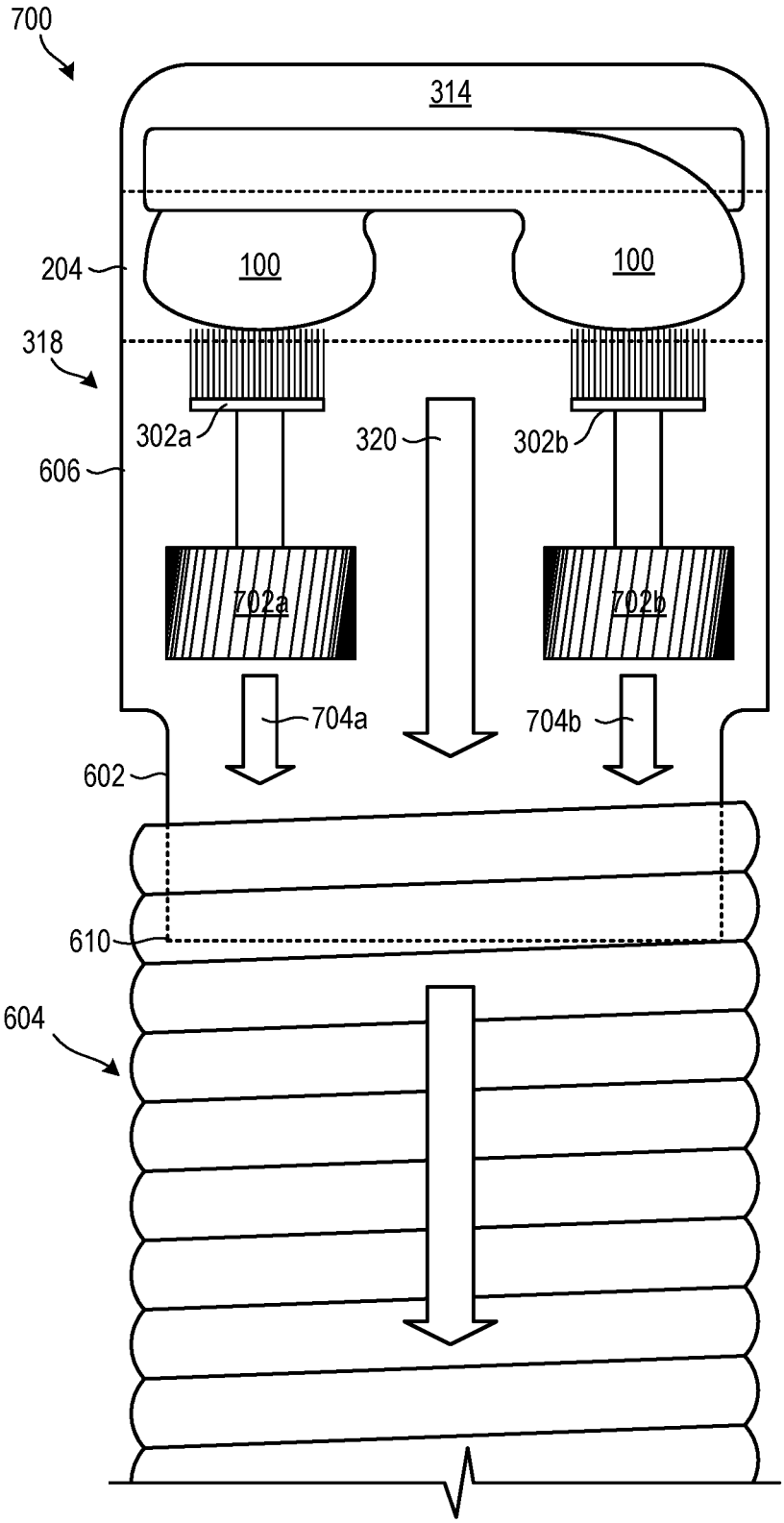
FIG. 7 is a cutaway side view of a fifth embodiment of an earphone cleaning device in accordance with the invention.

Referring now to FIGS. 6 and 7, some embodiments of a cleaning device 600, 700 in accordance with the invention may be adapted to utilize an external vacuum attachment or hose 604. This external vacuum attachment or hose 604 may be attached to the cleaning device 600, 700 to take the place of the fan 306 or vacuum element within the device 600, 700. Operation of the external vacuum may create suction within the device 600, 700 to draw debris 106 dislodged from the screen components 104*a*, 104*b* into the hose 604 for disposal. Such embodiments may create a stronger vacuum force than an internal vacuum element may be capable of producing. Utilizing an external vacuum in this manner may also lower costs associated with the device 600, 700 by eliminating the need for an internal vacuum element, collection element 402, and/or associated circuitry.

As shown in FIG. 6, in one embodiment, the housing 318 includes a lower portion 602 having a reduced profile or circumference relative to an upper portion 606. This narrowing between the upper portion 606 and the lower portion 602 may enable a vacuum hose 604 to easily attach to and, in some embodiments, be retained by the lower portion 602, without allowing the whole of the device 600 to be drawn into the hose 604. As shown, some embodiments may include a distinct ledge 608 between the upper portion 606 and the lower portion 602, with the lower portion 602 being received into the hose 604. The ledge 608 may create a physical barrier preventing the hose 604 from extending onto the upper portion 606 of the housing 606.

In other embodiments, an outer circumference or profile of the upper portion 606 may be gradually reduced towards the lower portion 602, such that the hose 604 circumference naturally stops the hose 604 at a point on the lower portion 602 of the housing 318. Operation of the external vacuum may create suction through the attached hose 604 and cleaning device 600, thereby drawing air and debris 106 from the screen components 104*a*, 104*b* in a direction 320 through the attached hose 604. A bottom edge 610 of the housing may be substantially open or may include one or more exit ports to enable the debris 106 to be easily collected and/or drawn through the hose 604.

Referring now to FIG. 7, some embodiments of a cleaning device 700 in accordance with the invention may also utilize an external vacuum to power internal cleaning elements, such as brush elements 302*a*, 302*b* and/or sanitizing elements 502*a*, 502*b* within the device 700, as well as to create a vacuum or air flow internal to the device 700.

For example, in one embodiment, pneumatically-powered motors 702*a*, 702*b* may be attached to each brush element 302*a*, 302*b*. Like the previous embodiment, an external vacuum may be coupled to a lower portion 602 of the cleaning device 700 via a vacuum attachment or hose 604. Operation of the external vacuum through the attached hose 604 may draw air in a direction 320 from the top cover 314 of the device 700 toward the attached hose 604.

In addition to creating a vacuum within the device 700, the air flow 320 may rotate the pneumatic motors 702*a*, 702*b* and associated brush elements 302*a*, 302*b* to remove debris 106 from the screen components 104*a*, 104*b*. Utilizing an external vacuum to power cleaning components internal to the cleaning device 700 in this manner may eliminate or reduce the need for an independent power source, such as a battery, and associated circuitry. This simplification may further reduce costs associated with the cleaning device 700.

In the above disclosure, reference has been made to the accompanying drawings, which form a part hereof, and in which is shown by way of illustration specific implementations in which the disclosure may be practiced. It is understood that other implementations may be utilized and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments, but should be defined only in accordance with the following claims and their equivalents. The foregoing description has been presented for the purposes of illustration and description. It is not intended to be exhaustive or to limit the disclosure to the precise form disclosed. Many modifications and variations are possible in light of the above teaching. Further, it should be noted that any or all of the aforementioned alternate implementations may be used in any combination desired to form additional hybrid implementations of the disclosure.

The invention claimed is:

1. An apparatus for cleaning earphones, comprising:

a housing configured to retain at least one earphone during a cleaning process;

a positioning element disposed within the housing and comprising at least one feature having a shape configured to maintain the earphone in a substantially fixed position relative to the positioning element during the cleaning process and at least one aperture disposed proximate to the earphone;

a brush element accessible through the aperture to contact the earphone;

a motive element coupled to the brush element, wherein the motive element is configured to move the brush element relative to the earphone to remove debris therefrom; and a vacuum element communicating with the aperture to draw the debris through the aperture for collection.

2. The apparatus of claim 1, wherein the positioning element positions a screen component of the earphone to substantially correspond to the brush element.

3. The apparatus of claim 1, wherein the shape substantially conforms to at least a portion of the earphone.

4. The apparatus of claim 1, wherein the housing contains at least one of the brush element, the positioning element, and the motive element.

5. The apparatus of claim 1, wherein the brush element one of mechanically rotates and oscillates to remove debris from the earphone.

6. The apparatus of claim 1, wherein the motive element is operably connected to the positioning element.

7. The apparatus of claim 1, further comprising a sanitizing element to apply a sanitizing agent to the earphone.

8. The apparatus of claim 1, further comprising a charging element operably connected to the earphone for charging the earphone.

9. The apparatus of claim 1, further comprising a collection element to collect the debris.

10. A method for cleaning earphones, comprising:

supporting, within a housing, an earphone during a cleaning process;

positioning, via a positioning element, the earphone within the housing, wherein the positioning element comprises at least one feature having a shape configured to maintain the earphone in a substantially fixed position relative to the positioning element during the cleaning process and at least one aperture disposed proximate to the earphone;

actuating a brush element such that the brush element at least partially contacts the earphone through the aperture to remove debris from the earphone; and drawing the debris through the aperture via a vacuum.

11. The method of claim 10, wherein supporting the earphone comprises positioning a screen component of the earphone to correspond to a position of the brush element.

12. The method of claim 11, further comprising containing within the housing at least one of the positioning element and the brush element.

13. The method of claim 10, further comprising charging the earphone within the housing.

14. The method of claim 10, wherein the vacuum is contained within the housing.

15. The method of claim 10, further comprising collecting the debris from the earphone within the housing.

16. The method of claim 10, further comprising sanitizing the earphone within the housing.

* * * * *